US007046114B2

(12) United States Patent
Sakata

(10) Patent No.: US 7,046,114 B2
(45) Date of Patent: May 16, 2006

(54) LAMINATED INDUCTOR

(75) Inventor: Keiji Sakata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 324 days.

(21) Appl. No.: 10/073,987

(22) Filed: Feb. 14, 2002

(65) Prior Publication Data

US 2002/0157849 A1 Oct. 31, 2002

(30) Foreign Application Priority Data

Feb. 14, 2001 (JP) ..... 2001-037072

(51) Int. Cl.
*H01F 5/00* (2006.01)

(52) U.S. Cl. ..... 336/200; 336/83; 336/232

(58) Field of Classification Search ..... 336/65, 336/83, 200, 206–208, 232; 29/602.1
See application file for complete search history.

(56) References Cited

U.S. PATENT DOCUMENTS 4,873,757 A * 10/1989 Williams ..... 29/602.1
5,781,093 A * 7/1998 Grandmont et al. ..... 336/232
5,880,662 A * 3/1999 Person et al. ..... 336/200

FOREIGN PATENT DOCUMENTS

JP 07-037719 2/1995
JP 8-069935 3/1996
JP 2000-286123 10/2000

* cited by examiner

*Primary Examiner*—Tuyen T. Nguyen
(74) *Attorney, Agent, or Firm*—Keating and Bennett, LLP

(57) ABSTRACT

A laminated inductor includes ceramic sheets provided with spiral coil conductor patterns of one turn, ceramic sheets provided with spiral coil conductor patterns of two turns, and ceramic sheets provided with lead-out conductor patterns, which are laminated together. The coil conductor patterns are successively electrically connected in series in regular order through via holes. The via holes are disposed at fixed locations in the ceramic sheets.

19 Claims, 6 Drawing Sheets

LAMINATED INDUCTOR

BACKGROUND OF THE INVENTION

1. Field of the Invention

The present invention relates to a laminated inductor and more particularly, the present invention relates to a laminated inductor for use as a noise filter or other component in, for example, various electronic circuits and apparatuses.

2. Description of the Related Art

Up to now, among such laminated inductors, an inductor in which a coil 50 is disposed inside of a laminated body by connecting spiral coil conductor patterns 51 and 52 in regular order through via holes 53 as shown in FIG. 6 is known. The coil 50 is composed of the coil conductor patterns 51 and 52, each of which constitutes two turns, and the via holes 53. That is, the coil 50 is constructed such that the coil conductor pattern 51 extending in a spiral direction from the outside to the inside and the coil conductor pattern 52 extending in a spiral direction from the inside to the outside are alternately disposed. In this way, the conventional spiral coil conductor patterns 51 and 52 have the same number of turns (two or more turns) and are alternately connected in series, and consequently, a high inductance was obtained in a small-sized inductor.

However, in the laminated inductor using the conventional spiral coil conductor patterns, since the coil conductor patterns 51 and 52 having a multiple number of turns (two or more turns) are used, the inductance of each turn cannot be adjusted, and accordingly, there was a problem in that the center value of conductance of each turn cannot be matched to each other.

Furthermore, in the conventional laminated inductor, when a necessary inductance cannot be obtained, such countermeasures as the use of coil conductor patterns having many turns, and the use of a material having a high permeability as a laminated body, were taken. However, when the number of turns is increased in the coil conductor patterns 51 and 52, it is necessary to reduce the pattern width of the coil conductor patterns 51 and 52. As a result, there was a problem in that the direct-current resistance of the coil 50 increases. Furthermore, when a material having a high permeability is used as a laminated body, the magnetic saturation occurs in the laminated inductor, and there was a problem in that the direct-current superposition characteristics deteriorate.

In this way, since the number of turns of the coil conductor pattern is restricted in the conventional laminated inductor, there was a problem in that the degree of freedom of design is low and that it is difficult to obtain the most appropriate characteristics.

SUMMARY OF THE INVENTION

In order to overcome the problems described above, preferred embodiments of the present invention provide a laminated inductor in which the degree of freedom of design is very high and the most appropriate characteristics can be easily obtained.

A laminated inductor according to a preferred embodiment of the present invention includes a laminated body in which a plurality of spiral coil conductor patterns having at least one turn are stacked with insulation layers disposed therebetween. In the laminated inductor, the plurality of coil conductor patterns are electrically connected in series to define a coil, and the coil includes at least two kinds of the coil conductor patterns which have a different number of turns.

The inductance of the coils disposed in the laminated body having the above-described unique construction varies in accordance with the total number of turns of the coil conductor patterns of at least two kinds having different numbers of turns. Therefore, when the coils include, for example, coil conductor patterns of one turn and coil conductor patterns of two turns, the inductance of the coils is adjusted in the unit of one turn by using the coil conductor pattern of one turn. On the other hand, a larger conductance can be obtained by using the coil conductor patterns of two turns. That is, the inductance of the coils can be easily made to reach a target value by combination of the spiral coil conductor patterns having different number of turns. At this time, since only a portion of the coil conductor patterns has a multiple number of turns, the coils have a low direct-current resistance.

Furthermore, the plurality of coil conductor patterns are electrically connected in series through via holes provided either at a first location or at a second location of the insulation layers. If the coil conductor patterns are changed, since the via holes are disposed at the same locations, only a few punching dies for forming the via holes in the insulation layers are required.

Furthermore, the coil conductor patterns having a greater number of turns are preferably arranged outside so as to sandwich the coil conductor patterns having a smaller number of turns in the lamination direction of the insulation layers. In the above-described unique construction, the number of turns in a coil conductor pattern becomes greater in the upper and lower surfaces than in the middle of the laminated body. Because of this, the distribution of direct-current resistance of the coil is low in the middle, and high in the upper and lower portions of the laminated body. Therefore, the amount of heat generation increases in the upper and lower portions of the laminated body where the heat dissipation capacity is high, and the amount of heat generation is suppressed in the middle where the heat dissipation capacity is low.

Furthermore, in contrast with this, when coil conductor patterns of a smaller number of turns are arranged outside, distortion caused when the insulation layers and coil conductor patterns are laminated and attached together by pressure can be reduced. Since the distortion at the attachment areas achieved by pressure is larger outside, the distortion can be decreased by disposing the coil conductor patterns of a smaller number of turns, in which distortion is not likely to occur, in the outer portions of the laminated body. In this manner, the efficiency of heat dissipation is increased and the distortion at the attachment areas achieved by pressure is decreased by arranging the coil conductor patterns in different ways. However, a trade-off between the efficiency of heat dissipation and the distortion, and consequently, these factors are determined according to specific applications and demands.

Furthermore, the coil conductor patterns are preferably arranged in an ascending order starting with a coil conductor pattern having a smaller number of turns in the lamination direction of the insulation layers. In such a construction, distortion caused when the insulation layers and the coil conductor patterns are laminated and attached together by pressure is greatly decreased.

Furthermore, a plurality of laminated portions, in each of which the coil conductor patterns are arranged in an ascending order starting with a coil conductor pattern having a smaller number of turns, are laminated in the lamination direction of the insulation layers. Because of the above-described unique construction, since the coil conductor patterns having a smaller number of turns are disposed to be substantially uniform between the coil conductor patterns having a multiple number of turns, distortion caused when the insulation layers and the coil conductor patterns are laminated and attached together by pressure is further reduced.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a laminated inductor according to the present invention are described with reference to the accompanying drawings.

Figure 1:
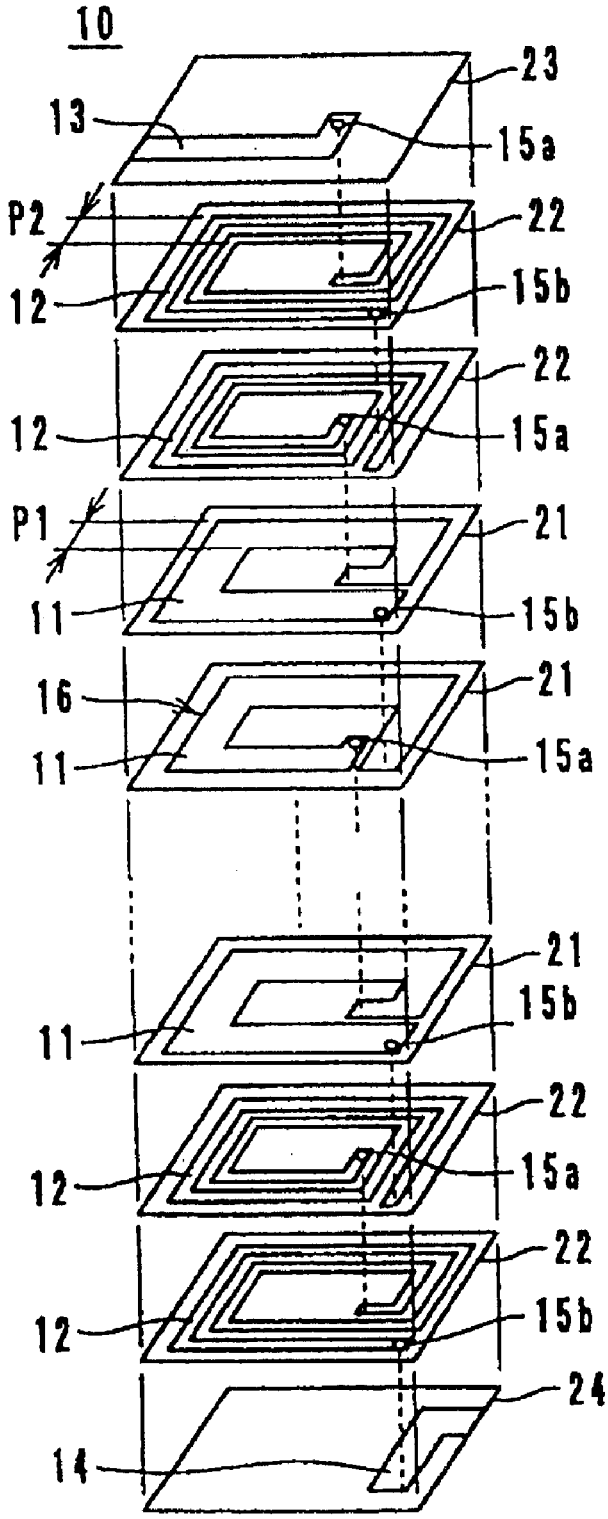
FIG. 1 is an exploded perspective view showing the construction of a laminated inductor according to a first preferred embodiment of the present invention.

As shown in FIG. 1, a laminated inductor 10 according to the first preferred embodiment includes of ceramic sheets 21 on each of which a spiral coil conductor pattern 11 constituting one turn is provided, ceramic sheets 22 on each of which a spiral coil conductor pattern 12 constituting two turns is provided, and ceramic sheets 23 and 24 on which lead-out conductor patterns 13 and 14 are provided, respectively. The ceramic sheets 21 to 24 are preferably formed such that a magnetic ceramic powder and a dielectric ceramic powder are mixed and kneaded together with a binder, and other suitable material, and are formed in sheets.

The ceramic sheets 21 on each of which a spiral coil conductor pattern 11 of one turn is provided are laminated, and the ceramic sheets 22 on each of which a spiral coil conductor pattern 12 of two turns is provided are laminated on the top and bottom surfaces of the laminated ceramic sheets 21, respectively. The pattern width in the spiral coil conductor pattern 11 of one turn is preferably larger than that in the spiral coil conductor pattern 12 of two turns. Moreover, on the upper and lower surfaces of the laminated ceramic sheets, the ceramic sheets 23 and 24 on which the lead-out conductor patterns 13 and 14 are provided are laminated, respectively. That is, in such a direction that the ceramic sheets 21 to 24 are laminated, the coil conductor patterns 12 having a larger number of turns are disposed on the upper and lower surfaces of the coil conductor patterns 11 having a smaller number of turns so as to sandwich the coil conductor patterns 11 having a smaller number of turns.

At this time, when the pattern width in the coil conductor pattern 11 of one turn is represented by P1 and the whole pattern width of the adjacent two patterns having a gap therebetween in the coil conductor pattern 12 of two turns is represented by P2, it is preferred that P1 is substantially equal to P2. Furthermore, the coil conductor pattern 11 and the coil conductor pattern 12 are arranged such that, when viewed from above, the coil conductor patterns 11 and 12 substantially lie one on top of another.

Preferred embodiments of the present invention further improve miniaturization and stability of the electrical characteristics of the inductor 10.

The coil conductor patterns 12 of two turns, the coil conductor patterns 11 of one turn, and the lead-out conductor patterns 13 and 14 are successively electrically connected in series through the via holes 15*a* and 16*b* which are formed in each of the ceramic sheets 21 to 23. In this way, the coil conductor patterns 11 and 12 constitute a coil 16 having a coil axis which is substantially parallel to the lamination direction of the ceramic sheets 21 to 24.

Here, the via holes 15*a* and 15*b* are formed at fixed locations of the ceramic sheets 21 to 23. That is, the via holes 15*a* are formed at the inner location of the spiral patterns in the coil conductor patterns 11 and 12 (at the first location in the ceramic sheets 21 to 23). On the other hand, the via holes 15*b* are formed at the outer location of the spiral patterns in the coil conductor patterns 11 and 12 (at the second location in the ceramic sheets 21 to 22). Accordingly, the via holes 15*a* and 15*b* are disposed at the same location with reference to the coil conductor patterns 11 and 12, respectively, and, when the through-holes as via holes are formed in the ceramic sheets 21 to 23 by using punching dies, a few kinds of punching dies are enough and the manufacturing cost of the laminated inductor 10 is greatly reduced.

Figure 2:
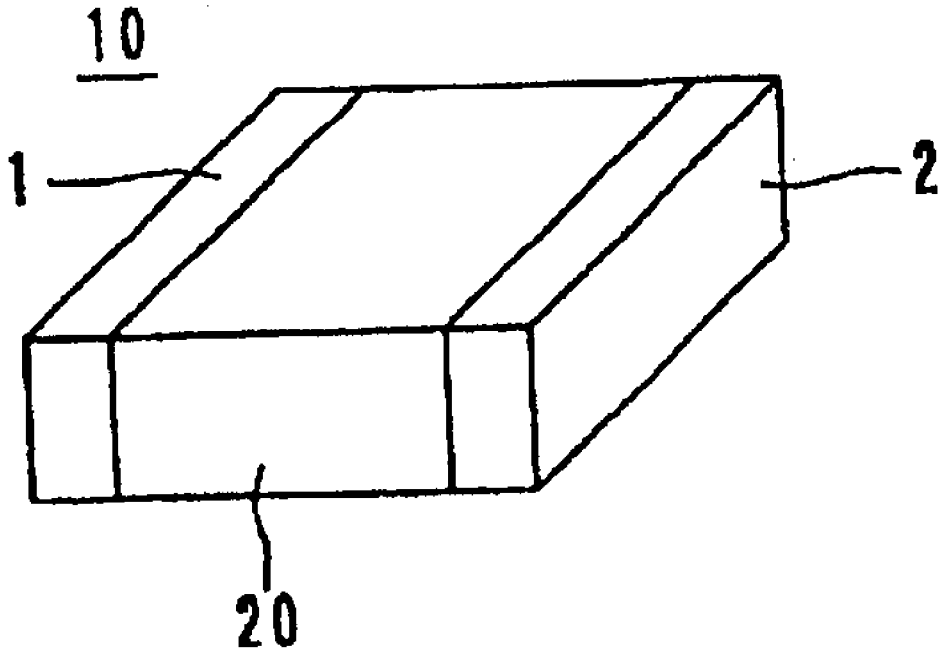
FIG. 2 is a perspective view showing the appearance of the laminated inductor in FIG. 1.

As shown in FIG. 1, the ceramic sheets 21 to 24 are put one sheet on another in regular order and covering ceramic sheets (not illustrated) with no conductor patterns thereon are disposed on their top and bottom surfaces of the stack of ceramic sheets 21–24, and, after that, they are pressed and integrally fired to form a laminated body 20 as shown in FIG. 2. Terminal electrodes 1 and 2 are provided at both end portions of the laminated body 20. The terminal electrodes 1 and 2 are formed such that, after a conductive paste of Ag, Ag—Pd, Cu, Ni, etc., has been coated, it is baked, or it is further plated. The terminal electrode 1 is electrically connected to the lead-out conductor pattern 13, and the terminal electrode 2 is electrically connected to the lead-out conductor pattern 14.

In the laminated inductor 10 having such a construction, the inductance of the coil 16 increases or decreases in accordance with the increase or decrease of the total number of turns of the two coil conductors 11 and 12 in which the number of turns is different between them. Accordingly, the number of turns of the coil 16 can be adjusted in the unit of one turn by adjusting the number of ceramic sheets in which the coil conductor pattern 11 of one turn is provided. That is, the inductance value of the coil 16 can be roughly adjusted by adjusting the number of ceramic sheets 21 in which the coil conductor pattern 11 of one turn is provided. Therefore, it is also possible to construct a coil having an even number of turns or an odd number of turns. Then, in the present preferred embodiment, fine adjustment of the inductance value of the coil 16 is achieved by changing the shape of the lead-out conductor patterns 13 and 14 in the same way as before. However, the lead-out conductor patterns 13 and 14 do not correspond to a spiral coil conductor pattern of one or more turns which is described above.

On the other hand, a higher inductance can be obtained by using the coil conductor pattern 12 of two turns. That is, the inductance of the coil 16 can be easily made to reach a target value by combination of the spiral coil conductor patterns 11 and 12 having different numbers of turns. At this time, since only the coil conductor pattern 12 has a multiple number of turns, an inductor 10 having a lower direct-current resistance can be obtained compared with the conventional laminated inductors in which all the coil conductor patterns have a multiple number of turns.

Furthermore, in the laminated inductor 10, since the number of turns in the coil conductor patterns located in the upper and lower portions of the laminated body 20 is preferably larger than that in the coil conductor patterns located in the middle of the laminated body 20, the direct-current resistance of the coil 16 is sparsely distributed in the middle of the laminated body 20 and is densely distributed in the upper and lower portions. Accordingly, the amount of heat generation increases in the upper and lower portions of the laminated body 20 where the heat dissipation capacity is high, and the amount of heat generation is suppressed in the middle where the heat dissipation capacity is low. Thus, the efficiency of heat dissipation is increased in the inductor as a whole.

Figure 3:
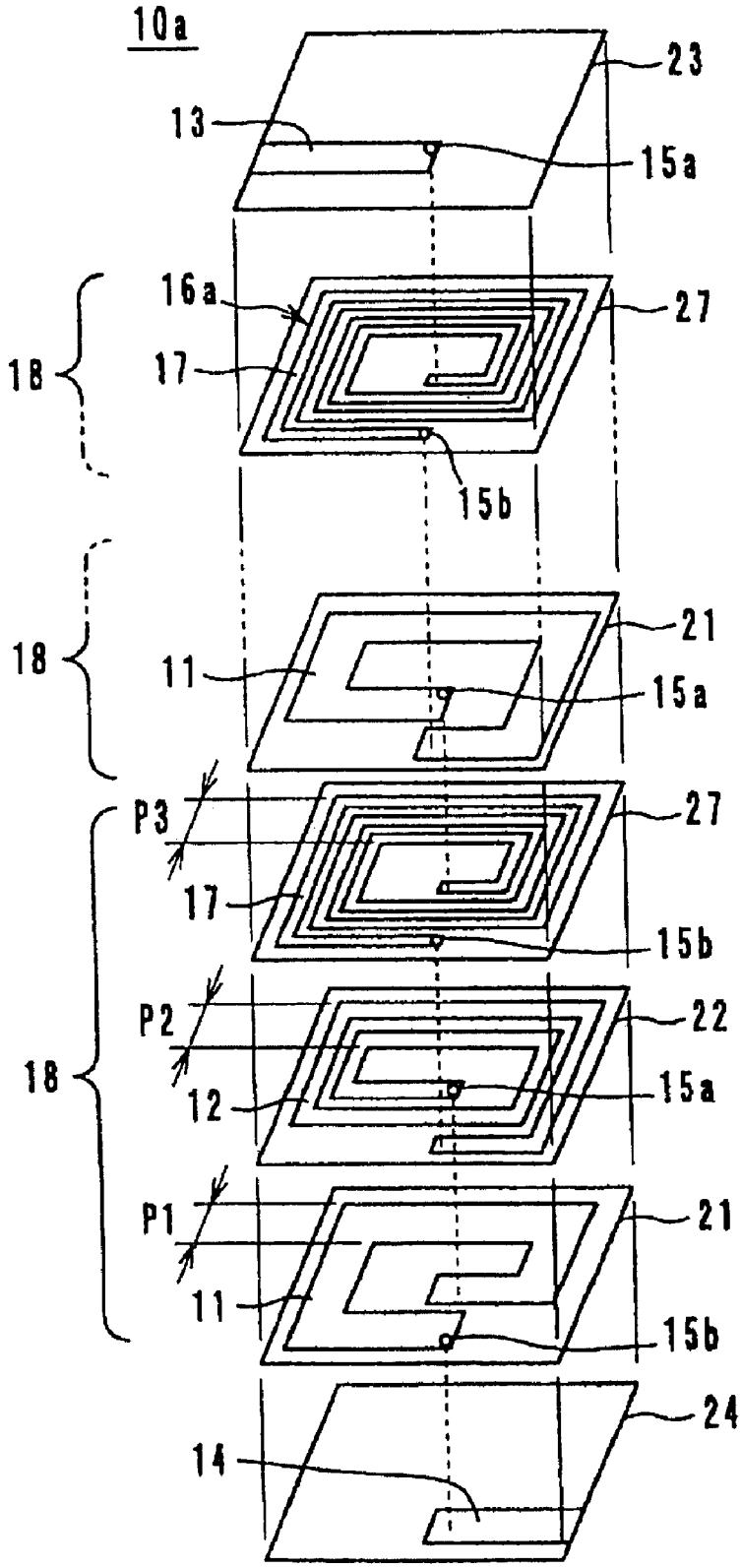
FIG. 3 is an exploded perspective view showing the construction of a laminated inductor according to a second preferred embodiment of the present invention.

The construction of a laminated inductor according to a second preferred embodiment of the present invention is shown in FIG. 3. In the laminated inductor 10*a*, a ceramic sheet 27 in which a spiral coil conductor pattern 17 of three turns is provided is used in addition to the ceramic sheet 21 provided with the spiral coil conductor pattern 11 of one turn and the ceramic sheet 22 provided with the spiral coil conductor pattern 12 of two turns in the laminated inductor 10 described with reference to FIGS. 1 and 2. That is, a laminated portion 18 is constructed such that the ceramic sheet 22 provided with a coil conductor pattern 12 of two turns is put on the ceramic sheet 21 provided with a coil conductor pattern 11 of one turn and that the ceramic sheet 27 provided with a coil conductor pattern 17 of three turns is put on the ceramic sheet 22. Then, a plurality of laminated portions 18 are laminated. Moreover, in FIG. 3, common elements corresponding to those in FIG. 1 are designated by the same reference numerals.

At this time, when the pattern width in the coil conductor pattern 11 of one turn is represented by P1, the whole pattern width of the adjacent two patterns having a gap therebetween in the coil conductor pattern 12 of two turns is represented by P2, and the whole pattern width of the adjacent three patterns having two gaps therebetween in the coil conductor pattern 17 three turns is represented by P3, P1 is substantially equal to P2 and P3. Furthermore, the coil conductor patterns 11, 12, and 17 are arranged such that, when viewed from above, the coil conductor patterns 11, 12, and 17 substantially lie one on top of another.

In order to further improve miniaturization and stability of the electrical characteristics of the inductor 10*a*, the coil conductor pattern 17 of three turns, the coil conductor pattern 12 of two turns, the coil conductor pattern 11 of one turn, and the lead-out conductor patterns 13 and 14 are successively electrically connected in series through the via holes 15*a* and 15*b* which are formed in each of the ceramic sheets 21 to 23, and 27. In this way, the coil conductor patterns 11, 12, and 27 constitute a coil 16*a* having a coil axis which is substantially parallel to the lamination direction of the ceramic sheets 21 to 24, and 27.

Here, the via holes 15*a* and 15*b* are formed at fixed locations of the ceramic sheets 21 to 23, and 27. That is, the via holes 15*a* are formed at the inner location of the spiral patterns in the coil conductor patterns 11, 12, and 17 (at a first location in the ceramic sheets 21 to 23, and 27). On the other hand, the via holes 15*b* are formed at the outer location of the spiral patterns in the coil conductor patterns 11, 12, and 17 (at a second location in the ceramic sheets 21 to 23, and 27).

As shown in FIG. 3, the ceramic sheets 21 to 24, and 27 are put one sheet on another in regular order and covering ceramic sheets (not illustrated) having no conductor provided thereon are disposed on their top and bottom surfaces, and then, they are pressed and integrally fired to form a laminated body 20 as shown in FIG. 2. The terminal electrodes 1 and 2 are provided at both end portions of the laminated body 20. The terminal electrode 1 is electrically connected to the lead-out conductor pattern 13, and the terminal electrode 2 is electrically connected to the lead-out conductor pattern 14.

In the laminated inductor 10*a* obtained in this way, the coil conductor patterns 11 of a smaller number of turns are disposed so as to be substantially uniform between the conductor patterns 12 and 17 of a multiple number of turns. Accordingly, distortion caused when the ceramic sheets 21 to 24, and 27 and the coil conductor patterns 11, 12, and 17 are laminated and attached together by pressure is minimized.

Generally, when a plurality of coil conductor patterns of a multiple number of turns are laminated, distortion caused by the attachment by pressure increases in this portion. This is because, since the pattern width becomes narrower in the coil conductor patterns of a multiple number of turns, distortion caused in the process of the lamination and attachment by pressure becomes larger due to a difference in level produced between the ceramic sheets and the coil conductor patterns. However, when the coil conductor patterns 11 of a smaller number of turns are disposed to be substantially uniform between the coil conductor patterns 12 and 17 of a multiple number of turns, since the coil conductor pattern 11 having a larger pattern width exist between the coil conductor patterns 12 and 17 having a smaller pattern width, distortion caused in the process of the lamination and attachment by pressure hardly occur.

As a result, in the laminated inductor 10*a*, in addition to the effect produced in the laminated inductor 10 according to the first preferred embodiment, economies of mass production are achieved and stable electrical characteristics can be obtained.

Figure 4:
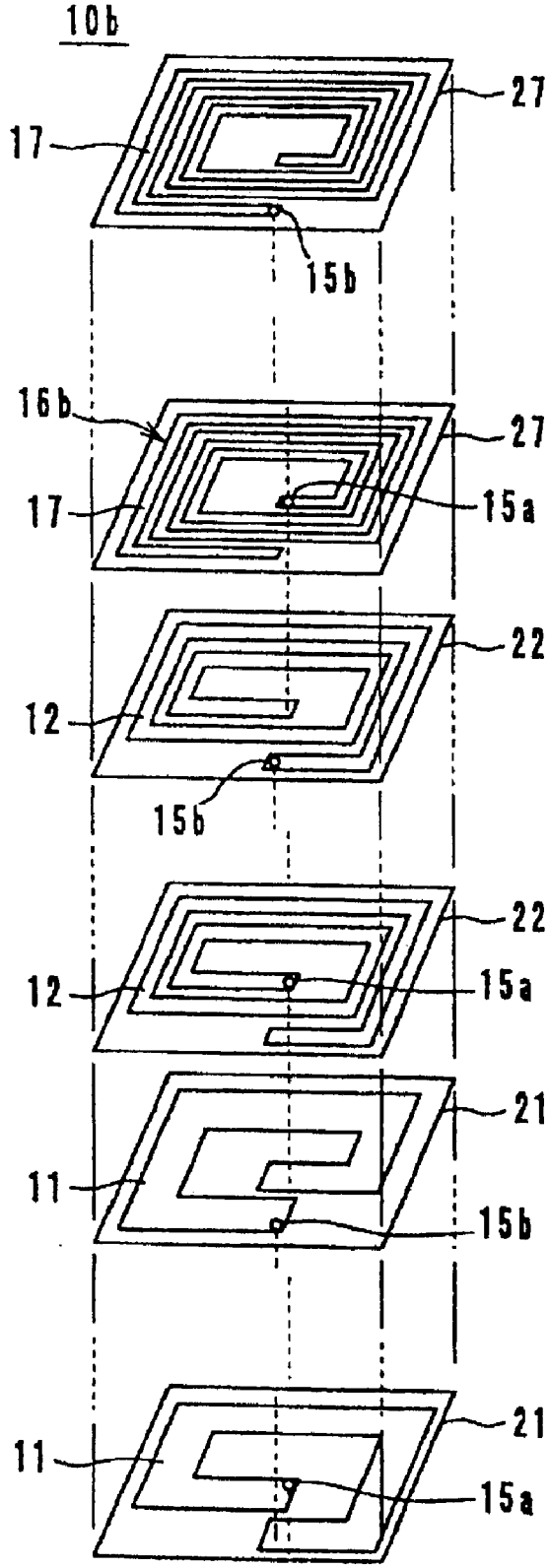
FIG. 4 is an exploded perspective view showing the construction of a laminated inductor according to a third preferred embodiment of the present invention.

The construction of a laminated inductor according to a third preferred embodiment of the present invention is shown in FIG. 4. In the laminated inductor 10*b*, a ceramic sheet 27 in which a spiral coil conductor pattern 17 of three turns is provided is used in addition to the ceramic sheet 21 provided with a spiral coil conductor pattern 11 of one turn and the ceramic sheet 22 provided with a spiral coil conductor pattern 12 of two turns in the laminated inductor described with reference to FIGS. 1 and 2. That is, the laminated inductor 10*b* is constructed such that a plurality of the ceramic sheets 22 provided with a coil conductor pattern 12 of two turns, which are laminated, are put on a plurality of the ceramic sheets 21 provided with a coil conductor pattern 11 of one turn, which are laminated, and that a plurality of the ceramic sheets provided with a coil conductor pattern of three turns are further put on the ceramic sheets 22. Moreover, in FIG. 4, the portions corresponding to those in FIG. 1 are designated by the same reference numerals.

In the laminated inductor 10*b* having the above-described unique construction, in addition to the effect produced by the laminated inductor 10 according to the first preferred embodiment, economies of mass production are achieved and stable electrical characteristics can be obtained.

Figure 5:
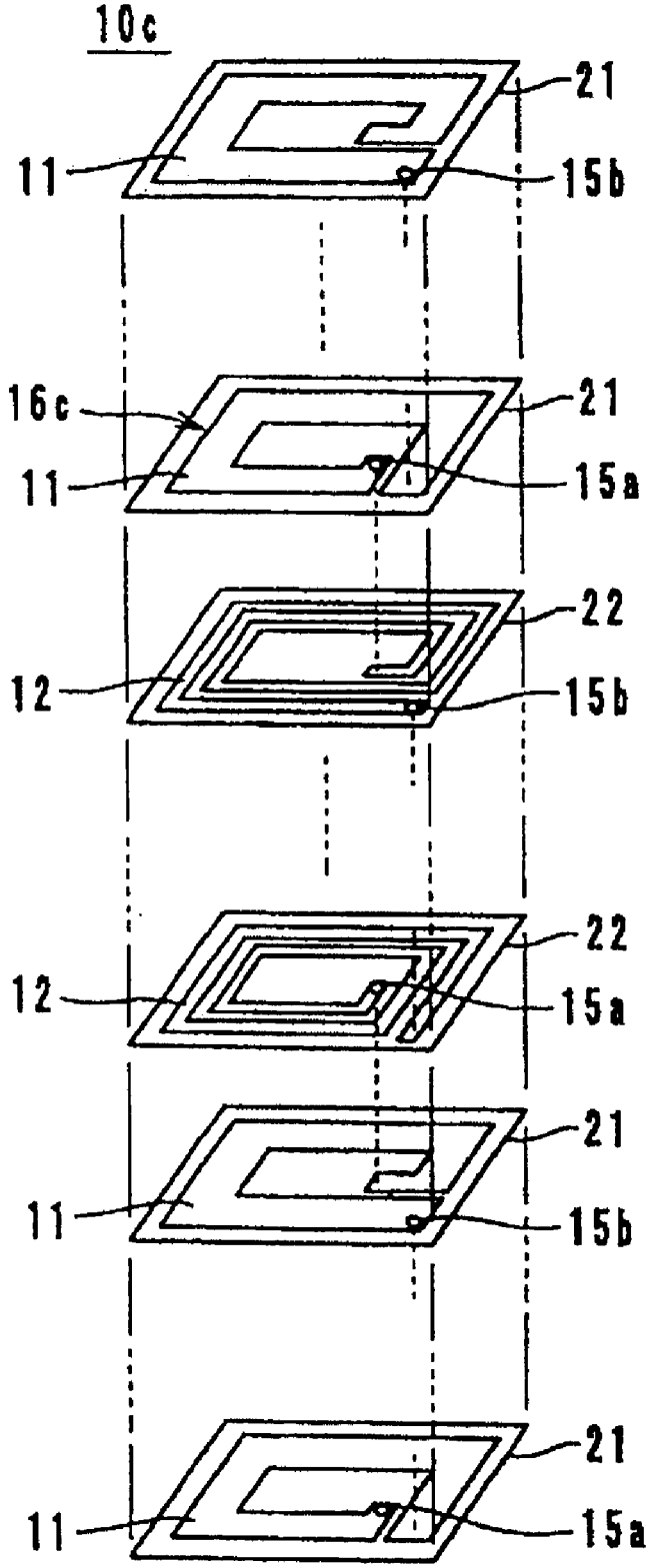
FIG. 5 is an exploded perspective view showing the construction of a laminated inductor according to a fourth preferred embodiment of the present invention.
Figure 6:
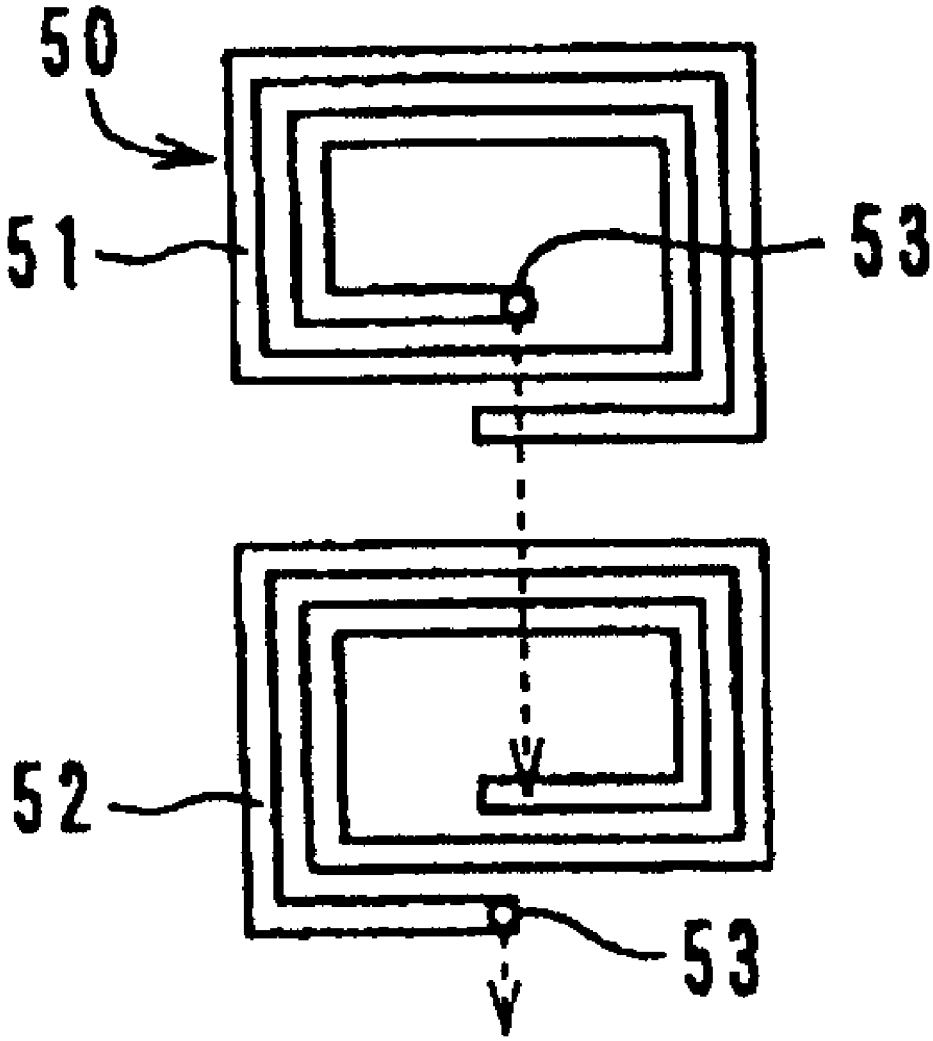
FIG. 6 PRIOR ART
FIG. 6 is a schematic illustration showing coil conductor patterns of a conventional laminated inductor.

The construction of a laminated inductor according to a fourth preferred embodiment of the present invention is shown in FIG. 5. In the laminated inductor 10*c*, in such a direction that the ceramic sheets 21 to 24 are laminated, the coil conductor patterns 11 having a smaller number of turns are disposed on the upper and lower surfaces of the coil conductor patterns 12 having a larger number of turns so as to sandwich the coil conductor patterns 12 having a larger number of turns. Moreover, in FIG. 5, common elements corresponding to those in FIG. 1 are designated by the same reference numerals.

In the laminated inductor 10*c* having the above-described unique construction, since the number of turns of the coil conductor patterns located on the upper and lower portions of the laminated body is preferably smaller than that of the coil conductor patterns located in the middle of the laminated body, distortion caused when the ceramic sheets 21 to 24 are laminated and attached together by pressure is greatly reduced. That is, since outside distortion is larger than inside distortion, distortion caused by the attachment by pressure is reduced by disposing the coil conductor patterns 11 of a smaller number of turns, in which distortion is not likely to occur, in the outer portions of the laminated body.

The present invention is not limited to the specific preferred embodiments described above, and it will be understood that various modifications may be made within the true spirit and scope of the invention. For example, the number of turns of coil, the shape of coil conductor pattern, etc., can be changed in various ways in accordance with various specifications.

Furthermore, the present invention can be applied to not only a laminated inductor, but also an inductor portion in lamination type LC composite devices, an inductor portion in lamination type LR composite devices, lamination type common-mode choke coils, and other suitable electronic apparatuses. Moreover, in the above-described preferred embodiments, an inductor in which the coil axis is substantially perpendicular to the mounting surface was taken as an example and described, but an inductor in which the coil axis is substantially parallel to the mounting surface may be used.

Furthermore, in the above-described preferred embodiments, after the ceramic sheets on each of which a coil conductor pattern is provided have been laminated, they are integrally fired, but the way of production is not limited to this. The ceramic sheets which have been fired in advance may be used. Furthermore, the inductor may be produced by a method described below. After insulation layers have been formed by a method of printing or other suitable process, using a paste-like ceramic material, a coil conductor pattern is formed by coating a paste-like conductive material on the surface of the insulation layer. Next, an insulation layer containing the coil conductor pattern therein is made by coating a paste-like ceramic material on top of the coil conductor pattern. In the same way, electrical connection is made between the coil conductor patterns, and by repeating such a coating in regular order, an inductor having a laminated construction can be obtained.

Next, actual examples of preferred embodiments of the present invention will be described. The target value of inductance to be obtained was set at about 22 μH and four kinds of laminated inductors (Sample No. 1 to Sample No. 4) were produced by using spiral coil conductor patterns of one turn and of two turns, and they were evaluated. The result is shown in Table 1. In Samples 1 to 3, only coil conductor patterns of the same number of turns were used, and in Sample 4, coil conductor patterns of different numbers of turns were combined. In Table 1, ceramic sheet material A is a ceramic material having a relatively low permeability, and ceramic sheet material B is a ceramic material having a relatively high permeability. In Table 1, the pattern width of the coil conductor patterns and the number of turns of the coils which were formed on Sample No. 1 to No. 4 of four kinds, and the inductance values, the direct-current resistance values, and the allowable currents of the coils which were actually obtained, are shown.

TABLE 1

| | | Coil conductor pattern | | | | Direct-current | Allowable |
|---|---|---|---|---|---|---|---|
| | Ceramic sheet material | Number of turns | Pattern width (mm) | Number of turns of coil | Inductance (μH) | resistance (Ω) | current (mA) |
| Sample No. 1 | A | 1 turn | 0.55 | 17.5 | 14.1 | 0.82 | 180 |
| Sample No. 2 | A | 2 turns | 0.25 | 18.5 | 22.2 | 1.75 | 160 |
| Sample No. 3 | B | 1 turn | 0.55 | 13.5 | 22.1 | 0.62 | 80 |
| Sample No. 4 | A | 1 turn<br>2 turns | 0.55<br>0.25 | 16.5<br>6.0 | 22.5 | 1.28 | 140 |

As will be understood from Table 1, in Sample No. 1, the obtained inductance value does not reach the target value 22 μH. On the contrary, in Sample No. 2 and Sample No. 3, the obtained inductance values practically reach the target value. However, the direct-current resistance is high in Sample No. 2, and the allowable current is low in Sample No. 3. On the other hand, the direct-current resistance and the allowable current in Sample No. 4 are more balanced.

As clearly understood in the above description of specific examples of preferred embodiments of the present invention, according to the present invention, since the coil disposed inside of a laminated body includes at least two kinds of spiral coil conductor patterns having different numbers of turns, it is possible to arbitrarily adjust the number of turns of coil by combination of coil conductor patterns having different number of turns and a laminated inductor having a desired inductance can be easily obtained.

Furthermore, it is possible to reduce kinds of punching dies for forming via holes such that via holes are provided either at a first location or at a second location of insulation layers, and, as a result, the manufacturing cost of a laminated inductor can be reduced.

Furthermore, the distribution of direct-current resistance of a coil becomes low in the middle portion of a laminated body and becomes high on the upper and lower portions of the laminated body such that the coil conductor patterns having a larger number of turns are disposed outside so as to sandwich the coil conductor patterns having a smaller number of turns in the laminated direction of the insulation layers. Accordingly, the amount of heat generation can be increased in the upper and lower portions of the laminated body where the efficiency of heat dissipation is high, and, as a result, a highly reliable laminated inductor in which the efficiency of heat dissipation is high can be obtained.

Furthermore, in contrast with this, when coil conductor patterns having a smaller number of turns are disposed outside, distortion caused when the coil conductor patterns and the insulation layers are laminated and attached together by pressure can be reduced. Since the distortion when attached by pressure is larger outside than inside, the distortion at the attachment by pressure can be reduced by disposing the coil conductor patterns having a smaller number of turns, which are likely to cause distortion, outside. In this way, by changing the location of coil conductor patterns, the efficiency of heat dissipation is greatly increased and distortion caused by the attachment by pressure is minimized.

Furthermore, distortion caused when the coil conductor patterns and the insulation layers are laminated and attached by pressure is reduced such that the coil conductor patterns are disposed in regular order starting with a coil conductor pattern having a smaller number of turns in the laminated direction of insulation layers.

Furthermore, coil conductor patterns having a smaller number of turns can be disposed to be substantially uniform between coil conductor patterns having a multiple number of turns such that a plurality of laminated portions, in each of which coil conductor patterns are disposed in regular order starting with a coil conductor pattern of a smaller number of turns, are laminated. Therefore, distortion caused when the insulation layers and the coil conductor patterns are laminated and attached together by pressure can be further reduced, and economies of mass production are achieved and stable electrical characteristics can be obtained.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A laminated inductor comprising:

a laminated body including a plurality of insulation layers and a plurality of coil conductor patterns having at least one turn and being stacked on each other in a lamination direction with the insulation layers being disposed therebetween; wherein the plurality of coil conductor patterns are electrically connected to define a coil, the plurality of coil conductor patterns of the coil includes at least a first kind and a second kind of the coil conductor patterns, and the first kind of the coil conductor patterns has a different number of turns and a different width from the second kind of the coil conductor patterns; and said first kind and said second kind of the coil conductor patterns are connected in series.

2. A laminated inductor according to claim 1, wherein the plurality of coil conductor patterns are electrically connected in series through via holes provided either at a first location or at a second location of the insulation layers.

3. A laminated inductor according to claim 1, wherein the first kind of the coil conductor patterns has a greater number of turns than the second kind of the coil conductor patterns and are arranged at an outer portion of said laminated body so as to sandwich the second kind of the coil conductor patterns in the lamination direction of the insulation layers.

4. A laminated inductor according to claim 1, wherein the first kind of the coil conductor patterns has a smaller number of turns than the second kind of the coil conductor patterns and are arranged at an outer portion of said laminated body so as to sandwich the second kind of coil conductor patterns in the lamination direction of the insulation layers.

5. A laminated inductor according to claim 1, wherein the plurality of the coil conductor patterns are arranged in an ascending order, starting with a coil conductor pattern having a smaller number of turns, in the lamination direction of the insulation layers.

6. A laminated inductor according to claim 1, wherein a plurality of laminated portions, in each of which the plurality of the coil conductor patterns is arranged in an ascending order, starting with a coil conductor pattern having a smaller number of turns, are laminated in the lamination direction of the insulation layers.

7. A laminated inductor according to claim 1, wherein at least one of the plurality of coil conductor patterns has one turn and at least another one of the plurality of coil conductor patterns has a plurality of turns and gaps between adjacent turns, and wherein a pattern width of the at least one of the plurality of the coil conductor patterns is substantially equal to a total pattern width, which is defined by plural pattern widths of the plurality of turns of a coil conductor pattern and the gaps between adjacent turns, of the at least another one of the plurality of coil conductor patterns.

8. A laminated inductor according to claim 2, wherein said first location is located inside of said plurality of coil conductor patterns and said second location is located outside thereof.

9. A laminated inductor according to claim 1, wherein the plurality of coil conductor patterns further includes a third kind of the coil conductor patterns which has a different number of turns from the first kind and the second kind of the coil conductor patterns.

10. A laminated inductor according to claim 1, wherein the plurality of coil conductor patterns includes a coil conductor pattern of one turn and a coil conductor pattern of two turns.

11. A laminated inductor according to claim 1, wherein the plurality of coil conductor patterns includes a coil conductor pattern of one turn, a coil conductor pattern of two turns, and a coil conductor pattern of three turns.

12. A laminated inductor according to claim 10, wherein the coil conductor pattern of one turn is disposed on a different insulating layer than the coil conductor pattern of two turns.

13. A laminated inductor according to claim 10, wherein the coil conductor pattern of one turn is disposed in a middle portion of the laminated body and the coil conductor pattern of two turns is disposed in an outer portion of the laminated body.

14. A laminated inductor according to claim 1, wherein the first kind and the second kind of the coil conductor patterns are arranged such that, when viewed from above, the turns of the first kind and the second kind of the coil conductor patterns substantially lie one on top of another.

15. A laminated inductor according to claim 1, wherein the first kind and the second kind of the coil conductor patterns are arranged such that the turns of the first kind and the second kind of the coil conductor patterns define a coil axis which is substantially parallel to the lamination direction.

16. A laminated inductor according to claim 1, further comprising cover insulating layers disposed on a top surface and a bottom surface of the laminated body, the cover insulating layers not having any conductor patterns provided thereon.

17. A laminated inductor according to claim 1, wherein the first kind of the coil conductor patterns has a smaller number of turns than the second kind of the coil conductor patterns and are disposed on the upper and lower surfaces of the second kind of the coil conductor patterns.

18. A laminated inductor according to claim 1, wherein the plurality of coil conductor patterns are electrically connected in series.

19. A laminated inductor according to claim 1, wherein the plurality of coil conductor patterns are electrically connected in parallel.

* * * * *